US006920725B2

(12) United States Patent
Lanphier

(10) Patent No.: US 6,920,725 B2
(45) Date of Patent: Jul. 26, 2005

(54) FALSE TREAD MODULES

(76) Inventor: Lee Lanphier, 1750 Anderson Creek Rd., Talent, OR (US) 97540

( * ) Notice: Subject to any disclaimer, the term of this patent is extended or adjusted under 35 U.S.C. 154(b) by 0 days.

(21) Appl. No.: 10/158,076

(22) Filed: May 29, 2002

(65) Prior Publication Data

US 2004/0010987 A1 Jan. 22, 2004

Related U.S. Application Data

(60) Provisional application No. 60/294,421, filed on May 29, 2001.

(51) Int. Cl.[7] ..... E04F 11/00; E04F 19/10

(52) U.S. Cl. ..... 52/182; 52/179; 52/188; 52/191

(58) Field of Search ..... 52/182, 191, 188, 52/186, 184, 179, 720.2

(56) References Cited

U.S. PATENT DOCUMENTS

| | | | | | |
|---|---|---|---|---|---|
| 844,408 | A | * | 2/1907 | Schachner | 52/191 |
| 2,021,457 | A | * | 11/1935 | Mackenzie | 52/191 |
| 2,760,239 | A | * | 8/1956 | Riley | 52/183 |
| 4,283,894 | A | * | 8/1981 | Raty | 52/311.1 |
| 4,464,870 | A | | 8/1984 | Crepeau | |
| 4,850,164 | A | | 7/1989 | McLeod | |
| 4,866,894 | A | | 9/1989 | Brown | |
| 4,875,315 | A | | 10/1989 | Champagne | |
| 5,163,491 | A | * | 11/1992 | Smith | 144/353 |
| 5,205,093 | A | | 4/1993 | Schuette | |
| 5,347,774 | A | * | 9/1994 | Smith | 52/182 |
| 5,502,933 | A | | 4/1996 | Skillern | |
| 5,613,341 | A | | 3/1997 | Skillern | |
| 5,720,136 | A | | 2/1998 | Turner | |
| 5,778,610 | A | | 7/1998 | Berg | |
| 5,791,101 | A | | 8/1998 | Wallace | |
| 5,806,254 | A | | 9/1998 | Bennett | |
| 5,899,032 | A | | 5/1999 | Buzby | |
| 6,088,977 | A | | 7/2000 | Lawrence | |
| 6,125,598 | A | | 10/2000 | Lanphier | |
| 6,230,454 | B1 | | 5/2001 | Meagher | |
| 6,397,529 | B1 | * | 6/2002 | Grenier | 52/182 |

OTHER PUBLICATIONS

Balustrade Installation Guide, pp 74–79; L.J. Smith Stair Systems, Bowerston, Ohio; Feb., 1996.
Promotional material, Coffman Hardwood Stair Parts; Coffman—a division of Visador Co., Marion, Virginia.
Stair Parts Catalog, Western Turnings/Stair Parts Company, Denver Colorado.
Stairways and Stair Parts, pp 9–10; CE Morgan.

* cited by examiner

*Primary Examiner*—Brian E. Glessner
*Assistant Examiner*—Chi Q. Nguyen
(74) *Attorney, Agent, or Firm*—Kolisch Hartwell, P.C.

(57) ABSTRACT

False return tread modules are provided that include a treadplate, a bullnose joined to the treadplate, a riserplate, and a stairbracket joined to the riserplate, such that the stairbracket/riserplate subassembly and treadplate/bullnose subassembly form the false tread module. The false tread modules of the invention permit fast and easy onsite installation, with or without preattached balusters.

19 Claims, 2 Drawing Sheets

FALSE TREAD MODULES

CROSS-REFERENCE TO RELATED APPLICATIONS

This application is based upon and claims benefit under 35 U.S.C. § 119(e) of U.S. Provisional Patent Application Ser. No. 60/294,421, entitled "False Tread Modules," filed on May 29, 2001, which is incorporated herein by reference.

FIELD OF THE INVENTION

The present invention relates generally to the construction of stairs, and more particularly to a modular assembly of treads, risers and balusters used in stairs.

BACKGROUND OF THE INVENTION

The present invention relates generally to the construction of stairs, and more particularly to modular, offsite, assembly of false treads in various combinations incorporating simulated tread and risers, stair brackets, and balusters to substantially reduce the on-site installation labor costs while producing a more appealing traditional-looking staircase. A number of stairparts manufacturers offer some components needed to construct false treads on site including: bullnose and bullnose/covemolding for simulating the front of a real tread; decorative thin tread material to cover up the construction tread, decorative thin riser material to cover up the construction riser; decorative thin stair brackets to apply to the outside. Some parts offer a partially preassembled false tread composed of a plate of tread material with moldings attached on two sides designed to be cut to fit on site. All previous approaches have resulted in difficult on-site installation, using less than factory-accurate tools, offering inconsistent results, and incurring significant delays in the completion of a pleasing finished staircase.

In contrast, the present invention provides for off-site construction of the most complete stair-finishing modules possible for straight, flared, curved, and other unusually shaped stairways. These modules may be packaged for delivery and speedy onsite installation. The modules offer the further advantageous ability to preattach the balusters from the underside of the treadplate to permit easy prefinishing and extra-tight fitting of baluster base to tread. With or without preattached balusters, the use of the instant modules can eliminate all on-site mitering chores and reduce the installation of false treads to one or two easy steps. Simply described, the present invention simulates the appearance of a more expensive tread, riser, and stairbracket with an easy-to-install three- or four-sided cap that fits conventionally framed rough staircases or modular staircases as described in my earlier U.S. Pat. No. 6,125,598, as well as U.S. Pat. Nos. 4,464,870, 4,850,164, 4,866,894, 4,875,315, 5,205,093, 5,502,933, 5,613,341, 5,778,610, 5,791,101, 5,806,254, 5,899,032, 6,230,454 B1, and 6,088,977, the disclosures of each of which are hereby incorporated by reference.

The invention provides modular false treads with returns that fully replace conventional piecemeal approaches to the construction and installation of simulated tread ends or full tread covers. Constructed from a variety of materials including wood, plastics, and composites, they may combine tread covering material, riser covering material, bullnose molding, and a decorative stairbracket in one, easy-to-install package complete with balusters. They can effectively simulate expensive installations of full sized and full thickness tread and riser installations for straight construction stairways, curved stairways, or even flairs.

SUMMARY OF THE INVENTION

False return tread modules are provided that are useful for covering a portion of a stair tread in a stairway construction. The false tread modules include a treadplate having a depth substantially equal to the depth of the stair tread portion to be covered, and a width substantially equal to the width of the stair tread portion to be covered. A bullnose/covemolding is joined to the treadplate to form a treadplate/bullnose subassembly, where the bullnose/covemolding extends substantially the width and depth of the treadplate so as to simulated a full thickness tread front and tread return. The treadplate/bullnose subassembly is coupled to a stairbracket/riserplate subassembly, where the stairbracket/riserplate subassembly includes a riserplate having a height substantially equal to the rise of the stair tread portion and a width substantially equal to the width of the stair tread portion, joined to a stairbracket having a height substantially equal to the rise of the stair tread, and a depth substantially equal to the run stair tread portion.

DETAILED DESCRIPTION OF THE INVENTION

Figure 1:
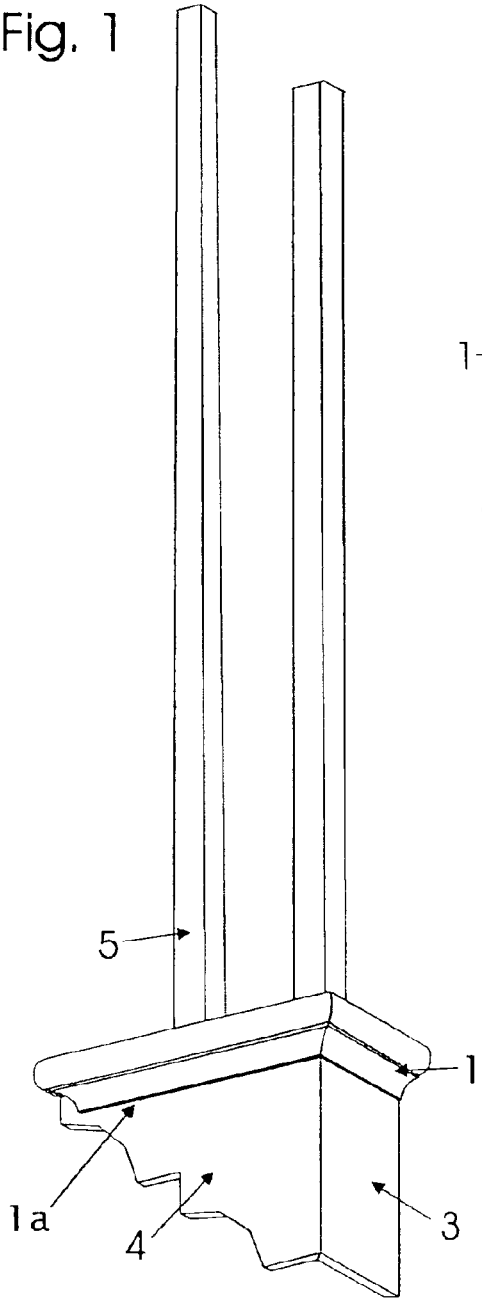
FIG. 1 is an isometric view of a complete false tread module, with balusters attached, that is ready for installation onto a straight section of a construction or framing stairway as shown in FIG. 3.
Figure 2:
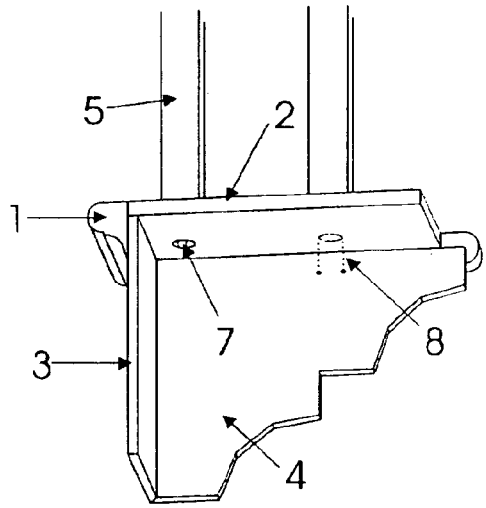
FIG. 2 is an isometric view of the back and underneath side of a complete false tread module showing its subcomponent parts.
Figure 3:
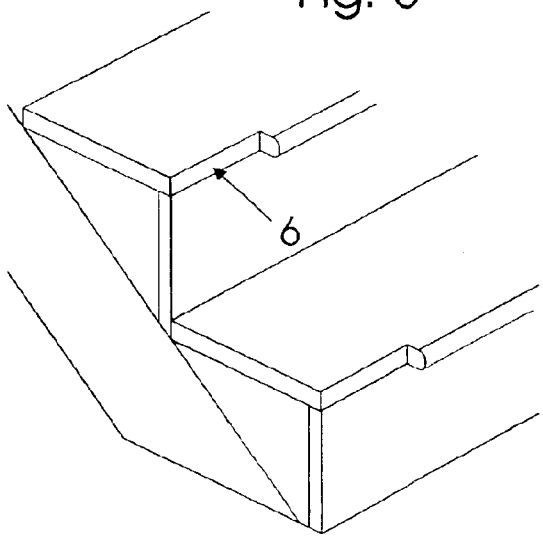
FIG. 3 is an isometric view of a construction framing stairway prepared to receive one or more outside false tread modules.

A false tread module of the invention is shown in FIG. 1. The false tread module may include a molded-in bullnose 1, a treadplate 2, a riserplate 3, and a stairbracket 4, in any combination. Bullnose I may be formed so as to incorporate covemolding 1*a*. The tread module may be machined and assembled from wood, plastic, or any other suitable material, or it may be injection-molded from a plastic or a composite material. In a preferred embodiment the preassembled false tread module includes one or more balusters 5 and is ready for attachment to a prepared open end 6 of a rough construction, or framing staircase, as shown in FIG. 3. In FIG. 2 the underside view of the false tread module shows a preferred mode of anchorage for balusters 5. Specifically, case pins or pegs on the bottom of each baluster are inserted into predrilled or premolded holes 7 in treadplate 2. A plurality of screws or other fasteners 8 may then be used to anchor each baluster to the tread from the underside of the treadplate.

Figure 4:
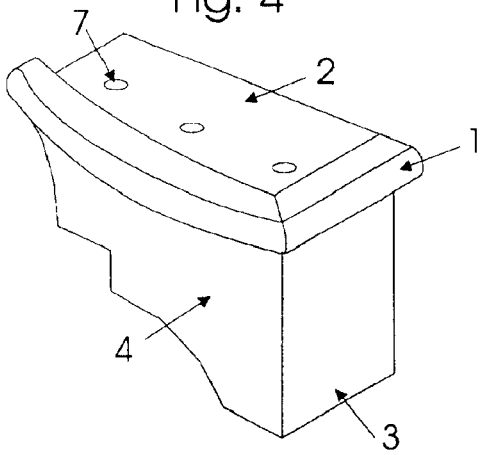
FIG. 4 is an isometric view of a false tread module ready for attachment of balusters and installation onto a curved tread section of a construction or framing stairway.

FIG. 4 depicts a false tread cap module suitable for installation on a curved staircase. The tread cap module includes bullnose/covemold 1, treadplate 2, riserplate 3, and stairbracket 4. It can be machined and assembled from wood, plastic, or other materials, or injection molded from a plastic or composite material, and preassembled with one or more balusters 5.

Figure 5A:
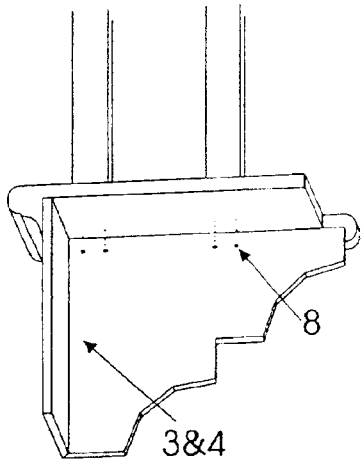
FIGS. 5*a* and 5*b* are isometric views of an alternative embodiment of a false tread module in which a riserplate/stairbracket subassembly is lightly fastened, or not fastened at all, to the upper assembly thereby allowing it to float up and down to adjust for minor variances in tread height.
Figure 5B:
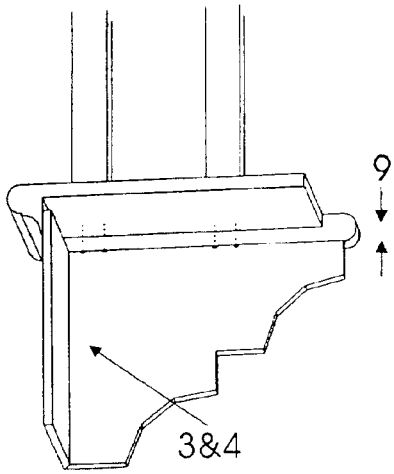

As with many types of rough construction, the framing staircase may exhibit minor fluctuations in tread heights. The false return tread module of the invention may be configured to accommodate such minor fluctuations, for example by permitting an adjustable vertical spacing between the riser/stairbracket portion and the treadplate/bullnose portion. As shown in FIGS. 5*a* and 5*b,* the riser/stairbracket portion 3&4 is configured to adjustably slide up and down with respect to the treadplate/bullnose portion (1&2) up to a maximum vertical displacement distance 9. The exemplified false tread module shown in FIGS. 5*a* and 5*b* does not include preformed holes for baluster pins, but is rather configured to secure one or more balusters using screws or other fasteners 8.

Figure 6:
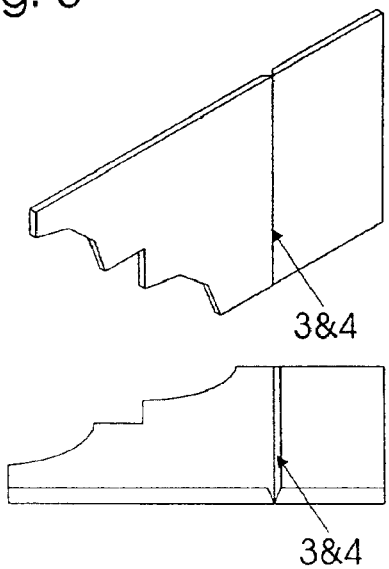
FIG. 6 is a view of an alternative fabricating approach to the manufacture of a riserplate/stairbracket subassembly in which the part is injected in a flat piece, or machined out of a flat piece of plastic or composite.

The riser/stairbracket portion 3&4 shown in FIG. 6 is injected molded or machined from plastic or other materials. Riser/stairbracket portion 3&4 is configured so that it may be folded into a substantially right angle and bonded into position for use as described above as a component of the false tread module of the invention, including use as an adjustable component configured to accommodate minor fluctuations in tread height. In particular, riser/stairbracket portion 3&4 may be molded or machined to include scoring or a crease in an appropriate position to facilitate folding into an appropriate right angle configuration.

Although the present invention has been shown and described with reference to the foregoing operational principles and preferred embodiments, it is to be understood that the specific embodiments thereof as disclosed and illustrated herein are not to be considered in a limiting sense, and that no single feature, function, or property of a particular embodiment is essential. It will be apparent to those skilled in the art that various changes in form and detail may be made without departing from the spirit and scope of the invention. The present invention is intended to embrace all such alternatives, modifications and variances that fall within the scope of the appended claims.

What is claimed is:

1. A preassembled false return tread module for covering a portion of an existing stair tread in a stairway construction, the stair tread having a depth, a width, a rise, and a run, the false tread module comprising:

a) a treadplate having a depth substantially equal to the depth of the stair tread portion, and a width substantially equal to the width of the stair tread portion;

b) a bullnose joined to the treadplate to form a treadplate/bullnose subassembly, the bullnose extending substantially the width and depth of the treadplate so as to simulated a full thickness tread front and tread return;

c) a riserplate having a height substantially equal to the rise of the stair tread portion, and a width substantially equal to the width of the stair tread portion; and d) a stairbracket having a height substantially equal to the rise of the stair tread, and a depth substantially equal to the run stair tread portion, where the stairbracket is joined to the riserplate to form a stairbracket/riserplate subassembly; and wherein the stairbracket/riserplate subassembly is coupled to the treadplate/bullnose subassembly;

wherein the false return tread module is installed on the existing stair tread.

2. The false tread module of claim 1, where the bullnose further comprises a covemolding below the bullnose.

3. The false tread module of claim 1, where the bullnose includes a first bullnose section that extends substantially the width of the treadplate, and a second bullnose section that extends substantially the depth of the treadplate, and the first and second bullnose sections are joined with a miter joint.

4. The false tread module of claim 1, where the riserplate and the stairbracket are joined with a miter joint.

5. The false tread module of claim 4, wherein the riserplate and the stairbracket are joined using using 3M JETWELD adhesive.

6. The false tread module of claim 1, further comprising one or more balustrades mounted to the treadplate.

7. The false tread module of claim 6, where each balustrade is mounted to the treadplate using continuous thread screws through an underside of the treadplate.

8. The false tread module of claim 1, where the treadplate/bullnose subassembly includes a single injection-molded piece comprising plastic or composite material.

9. The false tread module of claim 1, where the riserplate/stairbracket subassembly includes a single injection-molded piece comprising plastic or composite material.

10. The false tread module of claim 9, where the riserplate/stairbracket subassembly is formed as a single flat section that is folded at the riserplate/stairbracket seam and bonded into a right angle configuration.

11. The false tread module of claim 1, where the riserplate/stairbracket subassembly and the treadplate/bullnose subassembly, taken in combination, are formed by a single injection-molded piece comprising plastic or composite material.

12. The false tread module of claim 1, where the stairbracket/riserplate subassembly is coupled to the treadplate/bullnose subassembly via an adjustable coupling to accommodate minor variations in tread heights.

13. A method of manufacturing a preassembled false tread module covering a portion of an existing stair tread in a stairway construction, comprising;

a) forming a treadplate/bullnose subassembly;

b) forming a riserplate/stairbracket subassembly;

c) joining the treadplate/bullnose subassembly and the riserplate/stairbracket subassembly to form the false tread module;

wherein the false tread module is installed on the existing stair tread.

14. The method of claim 13, further comprising joining one or more balustrades to the covemold/treadplate subassembly.

15. The method of claim 13, where forming the treadplate/bullnose subassembly comprises injection-molding the treadplate/bullnose subassembly as a unit.

16. The method of claim 13, where forming the riserplate/stairbracket subassembly comprises injection-molding a flat unit having a seam, folding the flat unit at the seam into a substantially-right angled configuration, and bonding the unit to preserve the right-angled configuration.

17. A method of stairway construction, comprising:

a) preparing a stairway including a rough tread; where the rough tread includes a stair tread portion to be covered having a depth, a width, a rise, and a run;

b) providing a preassembled false tread module, where the false tread module includes i) a treadplate having a depth substantially equal to the depth of the stair tread portion, and a width substantially equal to the width of the stair tread portion;

ii) a bullnose joined to the treadplate to form a treadplate/bullnose subassembly, the bullnose extending substantially the width and depth of the treadplate so as to simulated a full thickness tread front and tread return;

iii) a riserplate having a height substantially equal to the rise of the stair tread portion, and a width substantially equal to the width of the stair tread portion;

iv) a stairbracket having a height substantially equal to the rise of the stair tread, and a depth substantially equal to the run stair tread portion, where the stairbracket is joined to the riserplate to form a stairbracket/riserplate subassembly; and wherein the stairbracket/riserplate subassembly is coupled to the treadplate/bullnose subassembly; and c) installing the false tread module onto the rough tread.

18. The method of claim 17, further comprising installing one or more balustrades onto the false tread module before installing the false tread module onto the rough tread.

19. The method of claim 17, further comprising adjusting a vertical spacing between the stairbracket/riserplate subassembly and the treadplate/bullnose subassembly to match the rise of the stair tread portion.

* * * * *